US011041219B2

(12) United States Patent
Colomer Duran

(10) Patent No.: US 11,041,219 B2
(45) Date of Patent: Jun. 22, 2021

(54) METHODS FOR TANNING ANIMAL SKINS

(71) Applicant: DB PATENTS LTD., Birkirkara (MT)

(72) Inventor: Ramon Colomer Duran, Barcelona (ES)

( * ) Notice: Subject to any disclaimer, the term of this patent is extended or adjusted under 35 U.S.C. 154(b) by 189 days.

(21) Appl. No.: 15/743,077

(22) PCT Filed: Jul. 13, 2016

(86) PCT No.: PCT/IB2016/054178
§ 371 (c)(1),
(2) Date: Jan. 9, 2018

(87) PCT Pub. No.: WO2017/009786
PCT Pub. Date: Jan. 19, 2017

(65) Prior Publication Data

US 2019/0078169 A1 Mar. 14, 2019

(30) Foreign Application Priority Data

Jul. 14, 2015 (IT) ..... 102015000034080

(51) Int. Cl.
*C14C 3/16* (2006.01)
*C14C 3/28* (2006.01)

(52) U.S. Cl.
CPC . *C14C 3/16* (2013.01); *C14C 3/28* (2013.01)

(58) Field of Classification Search
CPC ..... C14C 3/16; C14C 3/28
See application file for complete search history.

(56) References Cited

U.S. PATENT DOCUMENTS

| | | | | |
|---|---|---|---|---|
| 2,941,859 A | | 6/1960 | Fein et al. | |
| 4,270,912 A | | 6/1981 | Prentiss | |
| 5,011,499 A | * | 4/1991 | Rathfelder | C14C 3/16 8/94.19 R |
| 5,372,609 A | | 12/1994 | Weiser et al. | |
| 5,492,539 A | | 2/1996 | Bauer et al. | |
| 5,505,864 A | | 4/1996 | Bauer et al. | |
| 2009/0172890 A1 | * | 7/2009 | Huffer | C14C 3/16 8/94.17 |

FOREIGN PATENT DOCUMENTS

| | | | | |
|---|---|---|---|---|
| CN | 1043957 A | | 7/1990 | |
| CN | 1159482 A | | 9/1997 | |
| CN | 1863930 A | | 11/2006 | |
| CN | 101525673 | | 9/2009 | |
| DE | 19906190 | * | 8/2000 | C14C 3/16 |
| DE | 19906190 A1 | | 8/2000 | |
| EP | 1029930 A1 | | 8/2000 | |
| JP | H06212200 A | | 8/1994 | |
| RU | 2039086 C1 | | 7/1995 | |
| RU | 2149901 C1 | | 5/2000 | |
| WO | 2005/038058 A1 | | 4/2005 | |
| WO | 2017009786 A1 | | 1/2017 | |

OTHER PUBLICATIONS

Sodium chloride brine table, Brine Maker Jan. 31, 2019.*
International Search Report and Written Opinion dated Oct. 18, 2016, in corresponding PCT Application No. PCT/IB2016/054178, 9 pages.
Chinese Office Action dated Aug. 8, 2019, CN Application No. 201680040935.X, 13 pages (including English ranslation).
Russian Search Report (with English translation) in corresponding Russian Application No. 2018103258/10 dated Jan. 28, 2020, 4 pages.
Russian Office Action (with English translation) in corresponding Russian Application No. 2018103258/10 dated Jan. 29, 2020, 9 pages.
Russian Decision to Grant (with English translation) in corresponding Russian Application No. 2018103258/10 dated May 26, 2020, 9 pages.
International Search Report and Written Opinion dated Dec. 12, 2018, in related International Application No. PCT/IB2018/056353, 15 pages.
Database WPI, CN 101525673 A, XP-002778298, Sep. 9, 2009, 2 pages.
Unknown, "Sodium Chloride Table", Brine Maker, www.Brinemaker.com, Jan. 31, 2019, 1 page.
"Tanning leather", The Leather Dictionary (www.leather-dictionary.com), downloaded Apr. 29, 2020 (10 pages).
Japanese Office Action in corresponding Japanese Application No. 2018-502182 (with English-language translation) dated Aug. 3, 2020, 8 pages.

* cited by examiner

*Primary Examiner* — Amina S Khan
(74) *Attorney, Agent, or Firm* — MH2 Technology Law Group, LLP

(57) ABSTRACT

A method for tanning animal skin may include: putting the animal skin in contact with a first tanning bath comprising (weight percentages referring to a pelt weight of the animal skin): water, at least one $C_2$-$C_8$ aliphatic dialdehyde in a quantity within a range of 2%-30%, and/or at least one non-ionic surfactant in a quantity within a range of 0.1%-20%, wherein the first tanning bath has a pH within a range of 1-5 and a density within a range of 3°Bé-10°Bé; bringing the pH of the first tanning bath to a pH greater than 5 and less than or equal to 8; and/or washing the animal skin to obtain a tanned animal skin.

20 Claims, No Drawings

METHODS FOR TANNING ANIMAL SKINS

CROSS-REFERENCE TO RELATED APPLICATION(S)

This application is a national stage entry from International Application No. PCT/IB2016/054178, filed on Jul. 13, 2016, in the Receiving Office ("RO/IB") of the International Bureau of the World Intellectual Property Organization ("WIPO"), published as International Publication No. WO 2017/009786 A1 on Jan. 19, 2017, and claims priority under 35 U.S.C. § 119 from Italian Patent Application No. 102015000034080, filed on Jul. 14, 2015, in the Italian Patent and Trademark Office ("IPTO"), the entire contents of all of which are incorporated herein by reference.

The present invention relates to an improved method for tanning an animal skin.

The tanning method of the present invention can be advantageously used in field of tanning processes for the transformation of animal skins into leather.

The combination of manual, mechanical and physico-chemical operations through which animal skins are transformed into leather, is generally indicated as tanning cycle, or tanning process.

The objective of a tanning process (hereinafter tanning) is to confer irreversible stability to the animal skin which would otherwise be subject to putrefaction. Tanning not only makes animal skin rotproof and therefore preservable with time, but it also gives the skin desirable properties, such as hydrothermal resistance, resistance to acids and alkalis, mechanical resistance and dimensional stability. These properties are obtained by reacting the collagen of the raw skin with various tanning agents so as to obtain the cross-linking of the polypeptide chains of collagen and its consequent inerting. An index of the effectiveness of the tanning process on skins is represented by the shrinkage temperature of the tanned skin.

Before being subjected to tanning, the raw skin, generally kept in salted or dried form, is subjected to a series of operations essentially aimed at eliminating the undesired parts of the skin, such as hair and fleshing, and preparing the part of interest, i.e. the derma, for receiving the tanning agents. These preliminary operations (so-called beamhouse operations) comprise, for example, soaking, fleshing, hair removal, liming, splitting, deliming, steeping and degreasing operations.

Depending on the type of tanning agent to be used, the skins to be tanned can also be subjected to a preliminary pickling treatment whose main function is to confer an optimal pH value to the skin so that the collagen can react effectively with the tanning agent (generally a pH within the range of 1-5).

In the state of the art, the use is known of various aldehydes as tanning agents, such as glutaraldehyde 3-oxo-glutaraldehyde and thio-diglycolaldehyde.

U.S. Pat. No. 2,941,859, for example, describes the use of glutardialdehyde (1,5-pentanedial) as the sole tanning agent in the tanning of cow and sheep skins. Tanning with glutardialdehyde requires relatively lengthy contact times of the skin with the tanning bath (up to 24 hours) and in any case allows modest shrinkage temperature values (Tc) to be reached, in particular in the case of sheep- and goat-skins (Tc=81--83° C.)

U.S. Pat. No. 5,372,609 describes the tanning treatment of skins using tanning baths based on aqueous solutions of 3-oxoglutardialdehyde ($OHC—CH_2—O—CH_2—CHO$).

The tanning of sheepskins (duration of 4 hours) with this tanning agent leads to rather low Tc values, around 70° C.

Due to their poor effectiveness in terms of Tc values obtainable, their commercial cost and tendency towards yellowing of the tanned skin, aldehyde tanning agents, in particular glutardialdehyde, are nowadays used mainly as tanning agents for pre-tanning treatments or the re-tanning of skin, for example in tanning processes that envisage chrome tanning or vegetable tanning as main tanning treatment. In these cases, chrome or vegetable tanning agents are consequently used as main tanning agents or sole tanning agents.

The pre-tanning of skins is a tanning treatment after which the skin is only partially tanned; its stability degree is therefore lower than that of completely tanned skins. Pre-tanned skin requires at least one further tanning treatment which makes the final properties of the skin substantially irreversible.

In general, pre-tanning treatment confers a Tc not higher than 70° C., to the skin; tanning treatment, on the contrary, confers a Tc higher than 70° C., to the skin.

The main task of the present invention is to overcome the drawbacks encountered in the state of the art, associated with the use of dialdehydes as tanning agents, in particular, as sole tanning agents.

Within this general task, a first objective of the present invention is to provide a tanning method for an animal skin wherein a tanning bath can be effectively used, containing short-chain aliphatic dialdehydes as main tanning agents or, more preferably, as sole tanning agents.

A second objective of the present invention is to provide a method for tanning an animal skin using short-chain aliphatic dialdehydes which is effective and has a short duration.

A third objective of the present invention is to provide a tanning method of an animal skin whereby it is possible to obtain tanned skins having a higher shrinkage temperature (Tc) with respect to tanning treatments with aldehydes of the known art.

A further objective of the present invention is to provide a tanning method of an animal skin whereby it is possible to obtain tanned skins having a high mechanical strength, which can be measured, for example, through the tear test.

The Applicant has now found that the above and other objectives which will appear more evident in the following description, can be reached by treating animal skins in a tanning bath containing at least one short-chain aliphatic dialdehyde, combined with at least one non-ionic surfactant in suitable weight ratios.

It has been observed, in fact, that the use of at least one short-chain aliphatic dialdehyde, in particular glutaraldehyde, combined with a non-ionic surfactant allows substantially completely tanned skins to be obtained, whose properties are therefore stable with time.

The use of dialdehydes according to the present invention therefore allows to avoid the use of non-aldehyde tanning agents, in particular chrome tanning agents, in the same tanning bath (secondary tanning agents) or subjecting the skins to further treatments with non-aldehyde tanning agents in particular chrome tanning agents.

The use of non-aldehyde tanning agents as secondary tanning agents in the same tanning bath and also their use in separate tanning baths, in previous (pre-tanning) or subsequent (re-tanning) phases, are, in any case, not excluded from the present invention.

It has also been surprisingly observed that if the above treatment of skins in a tanning bath containing at least one short-chain aliphatic dialdehyde combined with at least one non-ionic surfactant, is followed by at least a second treatment in a tanning bath comprising at least one short-chain aliphatic dialdehyde in the absence of non-ionic surfactant, tanned skins can be obtained having a surprisingly high mechanical strength (measured, for example, through the double edge tear test ISO 3377-2: 2016). The high mechanical strength of the skins allows a reduction in the production of scraps during the processing process of the skins for the production of leather articles, and also to obtain leather articles having fewer defects.

In accordance with a first aspect, the present invention relates to a method for tanning an animal skin comprising the following phases:

a) putting said animal skin in contact with a tanning bath comprising (weight percentages referring to the pelt weight of said skin):
   water,
   at least one $C_2$-$C_8$ aliphatic dialdehyde in a quantity within the range of 2%-30%,
   at least one non-ionic surfactant in a quantity within the range of 0.1%-20%, said tanning bath having a pH within the range of 1-5 and a density within the range of 3 to 10° Bé;

b) bringing the pH of the tanning bath to a pH higher than 5 and lower than or equal to 8;

c) washing said skin, obtaining a tanned animal skin.

In accordance with a preferred embodiment, the above method also comprises the phase of putting the tanned skin obtained in phase c in contact with at least one tanning bath comprising (weight percentages referring to the pelt weight of said skin):

water, at least one $C_2$-$C_8$ aliphatic dialdehyde in a quantity within the range of 2%-30%, said tanning bath having a pH within the range of 1-5 and a density within the range of 3 to 10° Bé; and being substantially free of said non-ionic surfactant.

For the purposes of the present description and enclosed claims, the verb "comprising" and all terms deriving therefrom, also include the meaning of the word "consist" and the terms deriving therefrom.

The limits and numerical ranges expressed in the present description and enclosed claims also include the numerical value(s) mentioned. Furthermore, all the values and subranges of a limit or numerical range should be considered as being specifically included as if explicitly mentioned.

The method according to the invention can be applied within tanning processes for transforming an animal skin into leather.

The tanning method according to the present invention can be used for various kinds of skins. The animal skin can be selected for example from: sheepskin, goatskin, cow-hide (in particular calf- or small calf-hide), horseskin, pigskin, deerskin, kangaroo-skin, reptile-skin, ostrich-skin.

In particular, the method according to the present invention is preferably used for tanning sheepskin (which, as is known, is characterized by a high content of fatty substances), goatskin and cow-hide. The best results are in fact obtained with sheepskins, goatskins and cow-hides, in terms of increasing the shrinkage temperature (Tc), where a Tc of about 90° C. can be reached.

For the purposes of the present invention, the shrinkage temperature of a tanned skin is intended as being measured according to the standard method ASTM D6076-08(2013).

For the purposes of the present invention, the mechanical strength of a tanned skin is intended as being measured according to the standard method ISO 3377-2:2016.

According to a preferred embodiment, the skin to be subjected to the tanning treatment according to the present invention can be previously subjected to a pickling treatment in order to bring the pH of the pickled skin to a value lower than 4, preferably within the range of 1-3.

The pickling phase can be effected in accordance with techniques known in the state of the art. The pickling can be effected, for example, by putting the skin in contact with a pickling bath containing an aqueous solution of sulfuric acid, possibly mixed with formic acid. When necessary, for example in the case of skins to be pickled to a pH lower than 2, the pickling bath can contain salts (for example, sodium chloride) to increase the density of the solution and prevent the skin from swelling. The pickling bath typically has a density within the range of 3-10° Bé.

In accordance with a preferred embodiment, the skin to be subjected to tanning treatment according to the present invention can be previously subjected to a pre-tanning treatment, preferably in the absence of chrome tanning agents.

In accordance with a further preferred embodiment, the skin to be subjected to tanning treatment according to the present invention can be previously subjected to a pickling and/or pre-tanning treatment.

The tanning method according to the present invention preferably does not comprise any skin treatment phase in baths containing chrome tanning agents.

In accordance with the present invention, the tanning bath according to the present invention comprises water, at least one $C_2$-$C_8$ aliphatic dialdehyde (having an overall number of carbons atoms within the range of 2-8) as tanning agent and at least one non-ionic surfactant.

The aliphatic dialdehyde is preferably selected from: glyoxal, malonic dialdehyde, succinic dialdehyde, glutardialdehyde, adipic dialdehyde and pimelic dialdehyde or mixtures thereof. The tanning agent is preferably glutardialdehyde.

The tanning bath can comprise one or more of the above aldehydes.

The overall quantity of dialdehydes in the tanning bath is within the range of 2%-30% by weight referring to the pelt weight of the skins, preferably 3%-15%.

The tanning bath can also contain non-aldehyde tanning agents as secondary tanning agents; if present, their overall concentration does not exceed 30% by weight, referring to the pelt weight of the skin. The above-mentioned non-aldehyde tanning agents preferably do not include chrome tanning agents.

In a preferred embodiment, in the tanning bath, only one $C_2$-$C_8$ linear aliphatic dialdehyde is used, more preferably only glutardialdehyde.

In accordance with the present invention, the tanning bath comprises at least one non-ionic surfactant in a quantity within the range of 0.1%-20% by weight with respect to the pelt weight of the skins to be treated.

The non-ionic surfactant is preferably a primary alcohol containing ethoxylated groups (EO) or containing ethoxylated/propoxylated (EO/PO) groups.

The primary alcohol is a linear or branched alcohol having from 8 to 22 carbon atoms.

The average number of EO groups present on the molecules of ethoxylated alcohol (average ethoxylation number) is within the range of 1 to 40 moles of EO per mole of alcohol, preferably from 1 to 30.

The average number of PO groups present on the molecules of EO/PO alcohol is within the range of 1 to 20 moles of EO per mole of alcohol, preferably from 1 to 10.

The dialdehydes and non-ionic surfactants described above, as also the production processes thereof, are known to the person skilled in the art and available on the market.

The tanning bath preferably has a density within the range of 3-10°Bé. The density of the bath can be regulated by adding salts of alkali metals (in particular, sodium chloride) and alkaline-earth metals.

At the beginning of the treatment, the tanning bath preferably has a pH within the range of 1-5, more preferably within the range 1.5-4.

The treatment in the tanning bath preferably has a duration of 1-7 h, more preferably 1.5-5 h.

The temperature of the tanning bath is preferably within the range of 10-50° C., more preferably 15-40° C.

The quantity of tanning bath to be used can vary within a wide range in relation to the features of the skin to be treated.

The percentage weight ratio between the tanning bath and animal skin is preferably within the range of 20%-1000%, more preferably within the range of 30%-300% (weight percentage referring to the pelt weight of the skin).

The tanning treatment according to the present invention can be effected in accordance with the techniques and using the devices of the known art. The pickled or non-pickled skin to be treated can be immersed, for example, in the tanning bath inside a drum and mechanically stirred in the same.

At the end of the treatment in the tanning bath, if necessary, the pH of the tanning bath is brought to a pH value within the range of 5-8, preferably within the range 5.5-7, by the addition, for example, of alkali carbonates such as sodium carbonate or bicarbonate), alkali oxides, alkaline carbonates, and alkaline oxides (such as magnesium oxide).

The skin can be subsequently washed and subjected to further processing phases, such as, for example, a greasing phase or dyeing phase.

The washing is preferably carried out in a water bath at a temperature within the range of 20-60° C., more preferably within the range 30-50° C. The washing can be effected once or several times. Each washing phase can have a duration within the range of 0.5-4 hours.

The skin obtained at the end of the tanning in the bath containing the aliphatic dialdehyde and the non-ionic surfactant, is preferably subjected to at least one treatment in a second tanning bath, possibly after being subjected to washing with water.

The second tanning bath has the composition and pH and density characteristics described above with reference to the first tanning bath, except that the non-ionic surfactant is substantially absent, i.e. the concentration of said non-ionic surfactant is lower than 0.1% by weight with respect to the pelt weight of the skins to be treated, preferably lower than 0.05% by weight.

Moreover, the treatment in the second tanning bath is effected with the same pH, temperature, duration of the contact with the skins, tanning bath/skin weight ratio conditions as the treatment of phase a in the first tanning bath.

In a preferred embodiment, when the process according to the present invention also comprises the above-mentioned second treatment in a second tanning bath not containing the non-ionic surfactant, it is advantageous to use a concentration of aliphatic dialdehyde in the first bath higher than the concentration of the aliphatic dialdehyde in the second bath. The ratio between the concentration of the aliphatic dialdehyde in the second bath and that of the aliphatic dialdehyde in the first bath is preferably equal to or lower than 1/1.5, more preferably equal to or lower than ½.

At the end of the second tanning treatment, the treated skin is washed and possibly subjected to one or more subsequent finishing phases, such as a greasing phase or dyeing phase.

The greasing phase can be effected according to the known art. The greasing phase, for example, can be effected by putting the tanned skins into a water bath comprising at least a fat and/or a greasing oil (e.g. sulphated oils) and possibly one or more surfactants.

The greasing is preferably effected at a temperature within the range of 20-60° C., more preferably within the range of 30-50° C.

The greasing treatment preferably has a duration ranging from 0.5 to 4 hours.

At the end of the greasing treatment, in order to fix the greasing substance to the skin, formic acid is preferably added to the greasing bath until the pH of the bath is lowered to a value within the range of 3-6.

The tanned skins obtained with the method according to the present invention have a very full and soft feel, in addition to higher tensile strength, tear resistance and shrinkage temperature with respect to the same skins tanned with aldehyde substances as sole tanning agent and in the absence of a non-ionic surfactant. In particular, with the method according to the present invention, tanned skins can be obtained, in particular sheepskins, goatskins and cow-hides, having a shrinkage temperature of up to 90° C.

In particular, with the method according to the present invention, tanned skins in particular, sheepskins, goatskins and cow-hides can be obtained, having a mechanical strength measured according to the method ISO 3377-2 within the range of 20-50 N (values referring to skins having an average thickness of 1.25 mm).

The following embodiment examples are provided for purely illustrative purposes of the present invention and should not be intended as limiting the protection scope defined by the enclosed claims.

EXAMPLE 1

A pickled sheepskin was subjected to tanning treatment according to the method of the present invention.

The tanning bath had the following composition (weight percentages referring to the pelt weight of the skin treated):

water,
60% of sodium chloride;
6% of glutaraldehyde,
12% of non-ionic surfactant (ethoxylated fatty alcohol—Foryl VLC3, Pulcra Chemicals);
pH=3.2.

The skin was treated in the tanning bath for 4 hours at 35° C. inside a drum. The percentage ratio between the weight of the tanning bath and the pelt weight of the skin was equal to 1,500%.

At the end of the treatment, sodium carbonate was added to the bath until the pH of the bath had been adjusted to a value within the range of 5.5-8.

The skin was then kept in the bath for 1.5 hours and subsequently washed with water and finally greased.

The greased skin was then dried and subjected to conventional softening and staking treatments.

At the end of these treatments, the shrinkage temperature Tc measured proved to be slightly lower than 90° C.

The mechanical resistance values measured according to the test ISO 3377-2 on two samples of skin (1A and 1B) are indicated in Table 1.

EXAMPLE 2

A portion of the skin obtained in Example 1, after the washing step (without being subjected to greasing), was treated in a second tanning bath.

The tanning bath had the following composition (weight percentages referring to the pelt weight of the skin treated):

water,

60% of sodium chloride;

3% of glutaraldehyde, pH=3.2.

The skin was treated in the tanning bath for 4 hours at 35° C. inside a drum. The percentage ratio between the weight of the tanning bath and the pelt weight of the skin was equal to 1,500%.

At the end of the treatment, sodium carbonate was added to the bath until the pH of the bath had been adjusted to a value within the range of 5.5-8.

The skin was then kept in the bath for 1.5 hours and subsequently washed with water and finally greased.

The greased skin was then dried and subjected to conventional softening and staking treatments.

At the end of these treatments, the shrinkage temperature Tc measured proved to be slightly lower than 90° C.

The mechanical resistance values measured according to the test ISO 3377-2 on two samples of skin (2A and 2B) are indicated in Table 1.

TABLE 1

| | SAMPLE | | | |
|---|---|---|---|---|
| PARAMETER | 1A | 1B | 2A | 2B |
| Average thickness (parallel) | 1.16 mm | 1.25 mm | 1.20 mm | 1.33 mm |
| Average thickness (perpendicular) | 1.16 mm | 1.27 mm | 1.18 mm | 1.27 mm |
| Average thickness (arithmetic average of parallel and perpendicular) | 1.16 mm | 1.26 mm | 1.19 mm | 1.30 mm |
| Average tear load (parallel) | 22 N | 21 N | 32 N | 30 N |
| Average tear load (perpendicular) | 26 N | 28 N | 37 N | 41 N |
| Average tear load (arithmetic average of parallel and perpendicular) | 24 N | 25 N | 35 N | 37 N |

The treatment step effected in a single step in a tanning bath with glutaraldehyde and non-ionic surfactant (Example 1) allows tanned skins to be obtained having adequate mechanical resistance values, i.e. higher than 20 N.

The additional treatment step effected with sole glutaraldehyde (Example 2) allows tanned skins to be obtained having mechanical resistance values about 50% higher with respect to the values observed on the skins obtained with the treatment in a single tanning bath with glutaraldehyde and non-ionic surfactant (Example 1).

The invention claimed is:

1. A method for tanning animal skin, the method comprising:

putting the animal skin in contact with a first tanning bath consisting of (weight percentages referring to a pelt weight of the animal skin):

water, at least one $C_2$-$C_8$ aliphatic dialdehyde in a quantity within a range of 2%-30%, at least one non-aldehyde tanning agent, that is not a chrome tanning agent, a quantity 4th a range of 0%-30%, and at least one non-ionic surfactant in a quantity within a range of 0.1%-20%, wherein the first tanning bath has a pH within a range of 1-5 and a density within a range of 3 degrees Baum é(°Bé)-10°Bé;

bringing the pH of the first tanning bath to a pH greater than 5 and less than or equal to 8;

washing the animal skin to obtain a tanned animal skin; and putting the tanned animal skin in contact with at least one second tanning bath comprising (weight percentages referring to the pelt weight of the animal skin):

water, and at least one $C_2$-$C_8$ aliphatic dialdehyde in a quantity within a range of 2%-30%, wherein the at least one second tanning bath has a pH within a range of 1-5 and a density within a range of 3°Bé to 10°Bé, and is substantially free of the at least one non-ionic surfactant.

2. The method of claim 1, wherein a ratio between a concentration of the at least one $C_2$-$C_8$ aliphatic dialdehyde in the at least one second tanning bath and the concentration of the at least one $C_2$-$C_8$ aliphatic dialdehyde in the first tanning bath is less than or equal to 1:1.5.

3. The method of claim 1, wherein the at least one $C_2$-$C_8$ aliphatic dialdehyde is selected from: one or more of glyoxal, malonic dialdehyde, succinic dialdehyde, glutardialdehyde, adipinic dialdehyde, pimelic dialdehyde, or mixtures thereof.

4. The method of claim 1, wherein the at least one $C_2$-$C_8$ aliphatic dialdehyde is glutardialdehyde.

5. The method of claim 1, wherein the at east one non-ionic surfactant is a primary alcohol having from 8 to 22 carbon atoms, and wherein the primary alcohol is ethoxylated (EO) or ethoxylated/propoxylated (EO/PO).

6. The method of claim 1, wherein the putting of the animal skin in contact with the first tanning bath has a duration within a range of 1 hour-7 hours.

7. The method of claim 1, wherein a weight percentage ratio between the first tanning bath and the animal skin is within a range of 20%-1000%.

8. The method of claim 1, wherein the animal skin is a pickled skin.

9. The method of claim 1, wherein the animal skin is selected from: sheepskin, goatskin, cowhide, horse-skin, pigskin, deerskin, kangaroo-skin, reptile-skin, or ostrich-skin.

10. The method of claim 1, wherein a temperature of the first tanning bath is within a range of 10° C.-50° C.

11. The method of claim 1, wherein a temperature of the first tanning bath is within a range of 15° C.-40° C.

12. The method of claim 1, wherein the pH of the first tanning bath is brought to a pH higher greater than or equal to 5.5 and less than or equal to 7.

13. The method of claim 1, wherein a ratio between a concentration of the at least one $C_2$-$C_8$ aliphatic dialdehyde in the at least one second tanning bath and the concentration of the at least one $C_2$-$C_8$ aliphatic dialdehyde in the first tanning bath is less than or equal to 1:2.

14. The method of claim 1, wherein the at least one $C_2$-$C_8$ aliphatic dialdehyde comprises glutardialdehyde.

15. The method of claim 1, wherein the putting of the animal skin in contact with the first tanning bath has a duration within a range of 1.5 hour-4 hours.

16. The method of claim 1, wherein a weight percentage ratio between the first tanning bath and the animal skin is within a range of 30%-300%.

17. The method of claim 1, wherein the animal skin is selected from: sheepskin, goatskin, or cowhide.

18. The method of claim 1, wherein after putting the tanned animal skin in contact with at least one second tanning bath, the shrinkage temperature of the tanned animal skin is about 90° C.

19. A method for tanning animal skin, the method comprising:

putting the animal skin in contact with a first tanning bath comprising (weight percentages referring to a pelt weight of the animal skin):

water, at least one $C_2$-$C_8$ aliphatic dialdehyde in a quantity within a range of 2%-30%, and at least one non-ionic surfactant in a quantity within a range of 0.1%-20%, wherein the first tanning bath has a pH within a range of 1-5 and a density within a range of 3 degrees Baum é(°Bé)-10°Bé;

bringing the pH of the first tanning bath to a pH greater than 5 and less than or equal to 8;

washing the animal skin to obtain a tanned animal skin; and putting the tanned animal skin in contact with at least one second tanning bath consisting of (weight percentages referring to the pelt weight of the animal skin):

water, at least one $C_2$-$C_8$ aliphatic dialdehyde in a quantity within a range of 2%-30%, and at least one non-aldehyde tanning agent, that is not a chrome tanning agent, in a quantity within a range of 0%-30%, wherein the at least one second tanning bath has a pH within a range of 1-5 and within a range of 3 degrees Baum é(°Bé)-10°Bé;

bringing the pH of the first tanning bath to a pH greater than 5 and less than or equal to 8;

washing the animal skin to obtain a tanned animal skin; and putting the tanned animal skin in contact with at least one second tanning bath consisting of (weight percentages referring to the pelt weight of the animal skin);

water, at least $C_2$-$C_8$ aliphatic dialdehyde in a quantity within a range of 2%-30% and at least one non-aldehyde tanning agent, that is not a chrome tanning agent, in a quantity within a range of 0%-30%, wherein the at least one second tanning bath has a pH within a range of 1-5 and a density within a range of 3°Bé to 10°Bé, and is substantially free of the at least one non-ionic surfactant.

20. A method for tanning animal skin, the method comprising:

putting the animal skin in contact with a first tanning bath consisting of (weight percentages referring to a pelt weight of the animal skin):

water, at least one $C_2$-$C_8$ aliphatic dialdehyde in a quantity within a range of 2%-30%, at least one non-aldehyde tanning agent, that is not a chrome tanning agent; in a quantity within a range of 0%-30%, and at least one non-ionic surfactant in a quantity within a range of 0.1%-20%, wherein the first tanning bath has a pH within a range of 1-5 and a density within a range of 3 degrees Baum é(°Bé)-10°Bé;

bringing the pH of the first tanning bath to a pH greater than 5 and less than or equal to 8;

washing the animal skin to obtain a tanned animal skin; and putting the tanned animal skin in contact with at least one second tanning bath consisting of (weight percentages referring to the pelt weight of the animal skin):

water, at least one $C_2$-$C_8$ aliphatic dialdehyde in a quantity within a range of 2%-30%, and at least one non-aldehyde tanning agent, that is not a chrome tanning agent, in a quantity within a range of 0%-30%, wherein the at least one second tanning bath has a pH within a range of 1-5 and a density within a range of 3°Bé to 10°Bé, and is substantially free of the at least one non-ionic surfactant.

* * * * *